United States Patent [19]

Dugan et al.

[11] 4,007,582

[45] Feb. 15, 1977

[54] METHOD AND APPARATUS FOR SYNCHRONIZING AN ELECTRODYNAMIC CLOCKWORK DRIVE

[75] Inventors: Robert W. Dugan; Charles R. Edson, both of Saratoga, Calif.

[73] Assignee: Eurosil, G.m.b.H., Munich, Germany

[22] Filed: Mar. 12, 1974

[21] Appl. No.: 450,355

[30] Foreign Application Priority Data

Mar. 13, 1973 Germany ..... 2312412

[52] U.S. Cl. ..... 58/23 A; 58/28 R; 331/116 M

[51] Int. Cl.[2] ..... G04C 3/00

[58] Field of Search ..... 331/116 M; 318/119–133; 58/23 R, 23 A, 23 AC, 28 R, 28 A, 28 B, 28 D, 33

[56] References Cited

UNITED STATES PATENTS

| | | | |
|---|---|---|---|
| 3,584,274 | 6/1971 | Dimitrios | 318/132 X |
| 3,597,634 | 8/1971 | Flaig | 58/23 A X |
| 3,798,521 | 3/1974 | Berney | 318/128 |
| 3,818,376 | 6/1974 | Keller et al. | 58/23 A X |
| 3,828,545 | 8/1974 | Tsuruishi | 58/23 A X |

*Primary Examiner*—Ulysses Weldon

*Attorney, Agent, or Firm*—Gregg, Hendricson, Caplan & Becker

[57] ABSTRACT

A circuit for synchronizing an electrodynamic clockwork drive including two inductors and two permanent magnet assemblies which are moved relative to a clockwork drive by a mechanical oscillation system having the inherent frequency $f$ and the first inductor is disposed in the operating circuit of a switching transistor and the second inductor is disposed in its control circuit so that current pulses induced in the second inductor trigger the switching transistor.

7 Claims, 7 Drawing Figures

Fig.1
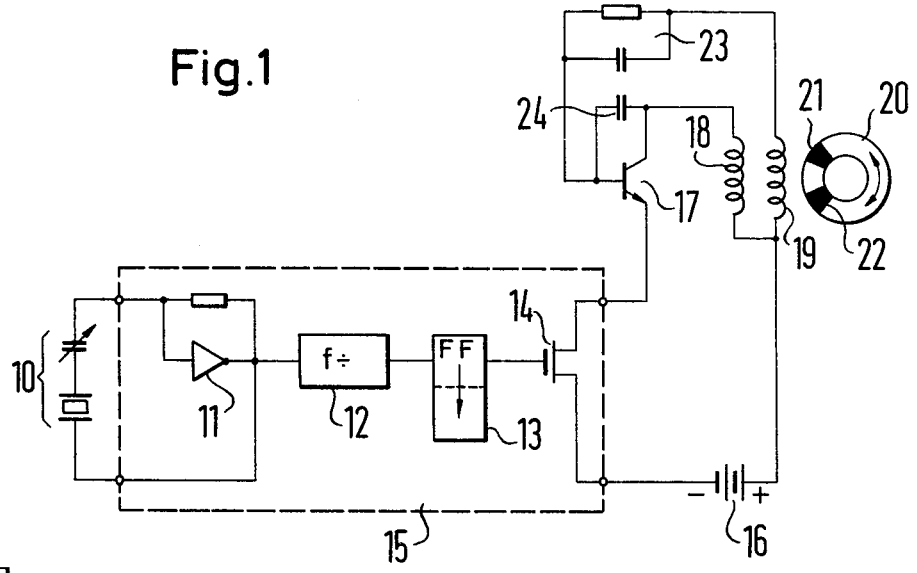
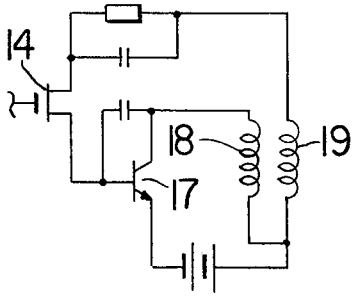
Fig. 1b
Fig. 1a
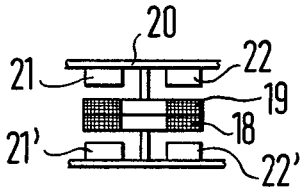
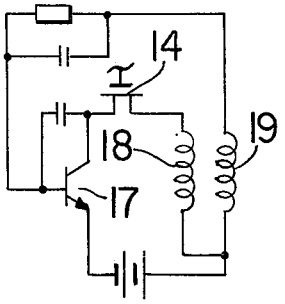
Fig. 1c
Fig.2
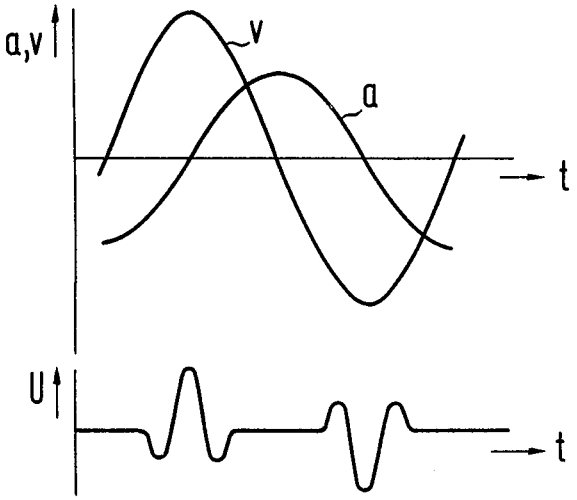

METHOD AND APPARATUS FOR SYNCHRONIZING AN ELECTRODYNAMIC CLOCKWORK DRIVE

BACKGROUND OF THE INVENTION

I. Field of the Invention

This invention relates to a synchronizing mechanism for a mechanical oscillation system and more particularly to mechanical oscillation systems in clockwork drives.

II. Description of the Prior Art

Mechanical swinging or oscillating systems of clockwork drives of the type of the present invention perform damped oscillations, but must swing with constant amplitude for driving the clockwork. For this purpose, it is necessary that in each oscillation state, sufficient energy is supplied to compensate for the damping of the oscillating system. The relative motion between the inductors and the permanent magnets during the swinging movement results in an induced voltage in the inductors having a known curve for the type of clockwork drives considered here. At an appropriate polarity the current pulse which is induced in the second inductor, or the control coil, switches a transistor to its conducting state and permits a driving current to flow through the first inductor, or the drive coil which is connected to a power supply, as long as the control pulse lasts. According to the electrodynamic principle, the oscillatory movement is thereby maintained by supplying the energy required for maintaining the mechanical swinging or oscillation. For accomplishing these principles, known circuit arrangements have the common property that the energy needed for sustaining the oscillation is more effectively supplied by a short driving pulse which is generated each time the mechanical system is in the state of its greatest kinetic energy and this occurs when the mechanical swinger moves through its central position which lies between the two extreme positions.

Known clockwork drives with two inductors and two permanent magnets generate induced current or voltage pulses having a polarity which alternates when the mechanical oscillator changes its direction of movement. Thus, the driving pulse can only be delivered with each second induced control pulse so that the energy required for the oscillatory movement can be supplied each time only once per oscillation period. Thereby, a synchronization system having a standard frequency can be attained by variable proportioning of the energy supplied whereby, for example, the phase difference between the frequency of the mechanical oscillations and a standard frequency can be evaluated.

The precision of mechanical oscillation systems, which in most cases include a spiral spring for energy storage, depends first of all upon the characteristics of this spiral spring. Good mechanical oscillation systems operate with a deviation from an accurate rate amounting to one second per day per degree centigrade, which means that the inherent frequency or the resonant frequency of the oscillation system can change by a relatively high amount, depending upon the ambient temperature.

Quartz clocks which are very expensive and operate with directly controlled precision stepping motors run with an error of two minutes per year. At present, such an accuracy is not obtainable by the use of a mechanical oscillation system. It has been suggested that it might be possible to improve the accuracy of the rate, or to synchronize the electrodynamic clockwork drives, by a standard frequency generated by a quartz crystal; however, in most cases, such synchronization methods require particular mechanical details of the clockwork drive. For example, the clockwork drive must be set to a high rate or frequency which is then adjusted to the standard frequency at regular intervals. On the other hand, it is necessary to provide for special stop pins in the oscillation system which prevent oscillation beyond a predetermined value so that the range of possible frequency changes remains limited.

SUMMARY OF THE INVENTION

An important object of the present invention is to provide an electrodynamic clockwork drive with two inductors and two permanent magnets without additional mechanical details and with as little electronic apparatus as possible and improved to such an extent so as to attain an accuracy of the rate which can correspond to that of a quartz clock.

To attain the above mentioned objects, a switching element is arranged in a first circuit for opening or closing this circuit, where the element is effectively switched preferably by rectangular synchronizing pulses of the frequency $2^a \cdot f$ where $a = 1, 2, 3, \ldots$, and the length or duration of the pulses is at least equal to the total width or duration of the current pulses induced in a first inductor when the inductors pass by the permanent magnet assemblies.

The present method makes it possible to maintain exactly the inherent frequency of the swinging or mechanically oscillating system since deviations from this frequency are automatically corrected. The foregoing is accomplished by use of the voltage or current pulses generated in the inductors. In the synchronized state and in a region of most positive or most negative deviations, a minimum of energy is supplied to the circuit whereas at larger positive and negative deviations from this state, higher energy values have to be supplied. In other words, a considerable advantage of the present invention is realized as compared with the previously known synchronization systems because when the clock runs too slow, the prior art systems need a higher additional energy amount than in the synchronous state whereas when the clock runs too fast, the prior art systems require a smaller energy amount than in the synchronous state.

The invention makes use of the fact that in drive systems having two inductors and two permanent magnetic fields, current pulses which alternate in their polarity with the swinging direction of the mechanical oscillator are induced in the inductors and that pulses of one polarity occur twice and pulses of the other polarity occur once. The double occurring pulses are situated symmetrically to the state of greatest kinetic energy of the mechanical oscillation system. This invention makes it possible to normally supply the energy necessary for the maintenance of the oscillatory movement at the moment of the single pulse, which may be termed a primary pulse, whereas on the other hand, the synchronization required in the case of an error is effected by at least one synchronizing pulse which is additionally available per oscillatory period, for which purpose one of the two secondary pulses are employed. These secondary pulses are situated symmetrically to a velocity maximum of the mechanical oscillation system. Hence, in case of an error of the oscillating system and an associated temporal displacement of the mechanical oscillation in relation to the synchronizing pulses, the method according to the invention uses only one of the secondary pulses for the required supply of additional energy which occurs with increasing or decreasing velocity. Hence, the generation of an additional energy supply for accelerating or retarding the oscillation movement becomes feasible by a simple method because in the case of temporal displacements of the above mentioned type, only one of the two secondary impulses can become effective. Thus, an automatic synchronization is brought about by the time controlled selection of additional pulses which although available have not been utilized up to that time. Hence, it becomes unnecessary to adjust the additional required energy amount with respect to the phase displacement, as has been done in the prior art.

The frequency of the synchronizing pulses has the value $2^a \cdot f$. Hence the synchronizing pulse frequency is at least equal to twice the frequency of the mechanical oscillation movement. Likewise, it can have 4 times or 8 times this value. Practical limits will become evident from the subsequent description which also contains an additional explanation of the effect caused by the pulse length.

The precision attainable by a synchronization method according to the invention was previously attainable only by directly controlled quartz clocks. The method according to this invention can be used for relatively simple clocks, which only need an additional electronic assembly that supplies synchronizing pulses and feeds them to the driving system.

DESCRIPTION OF THE DRAWINGS

The objects and advantages of the present invention will become apparent to those skilled in the art by reference to a preferred embodiment thereof illustrated in the accompanying drawings in which:

FIG. 1 is a schematic diagram of a suitable circuit for carrying out the method according to the present invention;

FIG. 1*a* is an enlarged side elevation sectional of the mechanical swinging system used in connection with FIG. 1;

FIGS. 1*b* and 1*c* are schematic diagrams of alternative circuit configurations of the present invention;

FIG. 2 illustrates some characteristic curves for mechanical and electric parameters in a circuit arrangement according to FIG. 1;

DESCRIPTION OF THE PREFERRED EMBODIMENT

Figure 3:
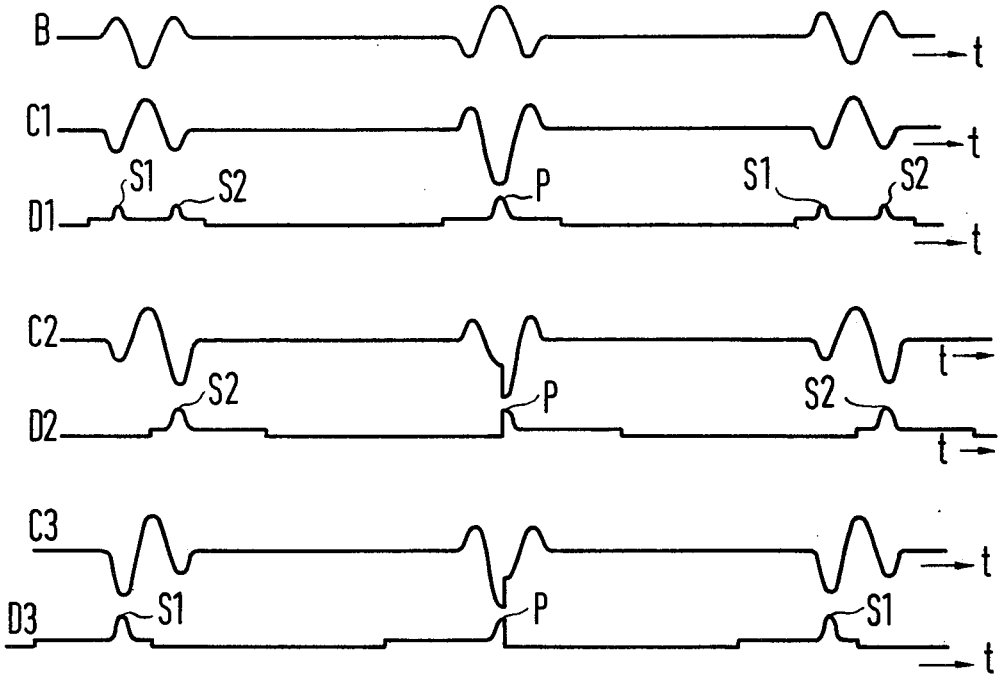
FIG. 3 illustrates signal patterns for the synchronous state and for positive and negative errors, the circuit arrangement being that of FIG. 1.

FIG. 1 illustrates an electrodynamic drive which is synchronized by the method of the present invention. For this purpose, the drive is connected with an additional circuit which essentially consists of a quartz crystal generator 10, the frequency of which is variable within narrow limits. A pulse forming circuit 15 is connected to the output of the generator 10. The quartz generator 10 has a frequency that is variable within narrow limits, and the pulse forming circuit 15 may be conventional and preferably comprises an integrating circuit containing an inverse feed-back amplifier 11, a frequency divider 12, a monostable one shot multivibrator 13, and a switching element 14 which in the embodiment shown is a field effect transistor (F.E.T.). Within the pulse forming circuit 15, the oscillations of the quartz generator 10 having a relatively high frequency are amplified and then divided down by the frequency divider 12 to a frequency which in the subsequent description is presupposed to have twice the value of the inherent or resonant frequency. The monostable one shot multivibrator 13 serves to adjust the length of rectangular pulses produced by the frequency divider 12 and which drive the field effect transistor 14 into a conducting state for the duration of each pulse; the importance of this will be subsequently discussed. The field effect transistor 14 connects the emitter of a switching transistor 17 to the negative terminal of a battery 16 with each rectangular pulse, thus establishing an electrically conducting operating circuit whenever the base of the switching transistor 17 has been triggered and a rectangular pulse drives the field effect transistor 14 into its conducting state.

The operating circuit of the switching transistor 17 also contains a drive coil 18 which in turn is connected to the positive terminal of the battery 16. In the base circuit of the switching transistor 17 there is disposed a control coil 19 which in the circuit under discussion is also inductively coupled with the drive coil 18. Such coupling is, however, not absolutely necessary. For example, the electrodynamic drive may be so designed that the control coil 19 is disposed at a point in the mechanical swinging system which is spaced from the drive coil 18. It is also necessary for the control pulse to be generated at the time of largest kinetic energy of a mechanical swinger or balance wheel as further discussed below.

Furthermore, the control or base circuit of switch transistor 17 comprises an RC network 23 which is connected in series to the base of the transistor 17 in a known manner and which not only generates the necessary base potential, but couples the control pulses to the base in the manner of an alternating current. A capacitor 24 connects the collector of the switching transistor 17 with its base and neutralizes electrical oscillations the frequency of which is determined by the values of the circuit elements.

The mechanical part of the drive shown in FIGS. 1 and 1a comprises a mechanical swinger 20 which, for example, can be a balance wheel, and which carries two permanent magnet assemblies 21 and 22. In FIG. 1*a*, this mechanical arrangement is additionally shown in an enlarged sectional side elevation which makes it evident that the two coils 18 and 19 may be directly adjacent each other and that they are moved across the two magnetic fields generated by the permanent magnets 21 and 21', 22 and 22'. When the mechanical swinger 20 carries out its oscillatory movement, then during each semi-period, both magnetic assemblies 21 and 22 are moved once past the two stationary coils 18 and 19 so that current pulses are generated in these coils 18 and 19. Alternatively, the coils 18 and 19 could be also moved past stationary permanent magnets.

The principle of the invention can only be properly understood if first the principal courses of movement and the pattern of the induced pulses are fully examined. Thus, FIG. 2 shows two graphs, the upper of which illustrates the mechanical parameters plotted against time and the lower of which illustrates an electrical parameter plotted against time.

The upper graph of FIG. 2 shows how the velocity *v* and the amplitude of movement *a* of the mechanical swinger 20 are correlated. According to the curve plotted for the amplitude *a* of the mechanical swinger 20 versus a central rest position which corresponds to the position shown in FIG. 1*a*, the mechanical swinger 20 is deflected in two directions, i.e., back and forth. For reasons of simplicity, this motion is depicted as a sinusoidal motion. The velocity *v* of the oscillatory movement has the value of zero at the points of reversal of the direction of movement of the mechanical swinger 20 at which time, the permanent magnet assemblies 21 and 22 have the largest distance from the coils 18 and 19 and the amplitude *a* is at a maximum. Conversely, the oscillation velocity *v* and, hence, the kinetic energy of the mechanical oscillator 20 reaches a maximum each time the mechanical swinger 20 passes through its central position.

The lower curve in FIG. 2 depicts the curve of a voltage U which is induced in the two coils 18 and 19 by movement of the magnets 21 and 22. The approximately constant voltage component generated by the battery 16 is omitted from FIG. 2. The shape of this induced voltage curve is well known for electrodynamic clockwork drives operating with a two-magnet system. It will be seen that depending upon the direction in which the mechanical swinger 20 moves, there is induced a voltage having a sign determined by the direction of movement. The shape of the curve for the induced voltage is easily understood if one considers that when one coil, such as coil 18 or 19, depicted in FIG. 1, is moved past the two permanent magnets 21 and 22, the following sequence occurs during this movement. First, one half of the coil is moved past the one permanent magnet, then, both halves of the coil are for a short time situated in the magnetic field of both permanent magnets, followed again by a single pulse which is generated by the second half of the coil at the second permanent magnet. In this manner, the resulting voltage curve consists of repeating units of three voltage pulses, of which the central pulse 25 has an opposite sign and greater amplitude as compared with the two outer pulses 26 and 27. The polarity of the pulses following for the next semi-period is opposite to the respective preceeding polarity. The central pulse 25 of large amplitude is generated each time the mechanical swinger 20 passes through its central position and the state of greatest kinetic energy exists.

It will be seen that to supply additional energy to such a driving system at a predetermined direction of movement of current flow is only possible if a voltage pulse of one of the two polarities is present. If the two coils 18 and 19 of the arrangement shown in FIG. 1 are situated in the central position of the mechanical swinger 20, then, a control pulse is generated in the control coil 19 each time the mechanical swinger 20 passes through a central position, which pulse triggers the base of the switching transistor 17 to drive the latter into its conducting state, provided, of course, that this pulse has a polarity suitable for this purpose. Thus a drive pulse is generated in the drive coil 18 once per swinging period of the mechanical swinger.

Figure 4:
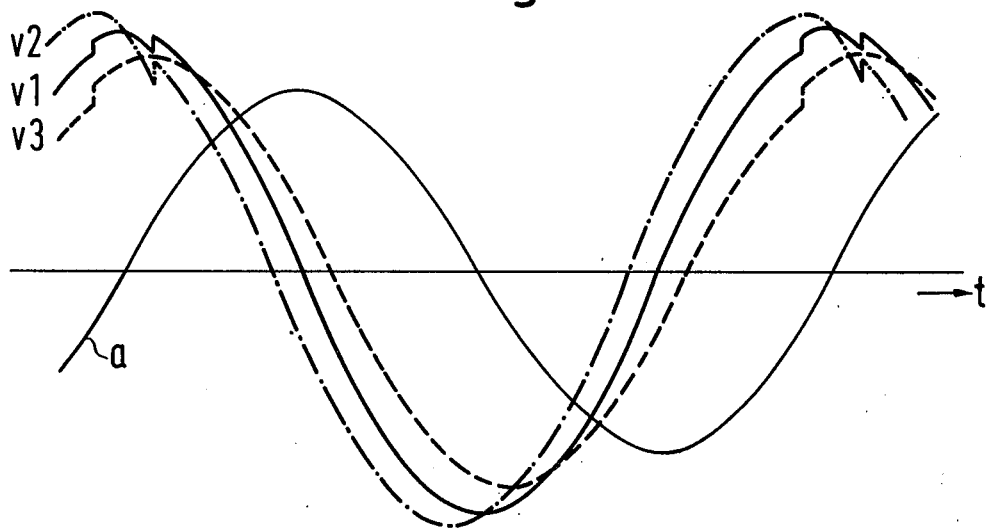
FIG. 4 shows variable rates of a clockwork drive for the synchronous state and for positive and negative errors.

The electrodynamic clockwork drive shown in FIG. 1 is synchronized in dependence upon the rectangular pulses which trigger the field effect transistor 14 into its conducting state twice each period of swinging or oscillation. The important relationships for synchronization are illustrated in FIGS. 3 and 4 in which the curves for the characteristic parameters of an electrodynamic driving system are shown for the synchronous state a positive error, and a negative error. FIG. 4 depicts the swinging velocity *v*1, *v*2, *v*3 for the respective three states of the mechanical oscillator 20 whereas FIG. 3 shows the respective signal patterns in the circuit of the switching transistor 17. In addition FIG. 3 depicts the base voltage of the switching transistor 17, which is common to all patterns.

The base voltage of the switching transistor 17 shown in FIG. 3 at B follows the curve which has been already described with respect to FIG. 2 for the induced voltage U. The curve B shown in FIG. 3, as well as the remaining signal patterns, are depicted without the respective direct or constant current component since only the alternating effects are needed for an understanding of the invention. The signal patterns B, C1, D1 shown in FIG. 3 correspond to the synchronous state which is described immediately below. In the case of the embodiment of the invention shown in FIG. 1 which includes an npn-transistor 17, the conducting state of the transistor 17 occurs when the induced voltage generates a positive voltage pulse at the base of the transistor. This means that the signal pattern B in FIG. 3 can generate conducting states of the switching transistor 17 for those pulses which are positive, i.e. directed upwards. The signal pattern C1 which is correspondingly depicted shows the voltage at the collector of the switching transistor 17. Each time the switching transistor is in the conducting state, voltage drops occur which generate negative voltage pulses in the curve C1. The amplitudes of these negative voltage pulses correspond to the amplitudes of the voltage pulses at the base of the switching transistor 17 so that for each second semi-period of the mechanical system, there occurs a strong negative voltage pulse in the curve C1 which results in a correspondingly strong current impulse in the drive coil 18. At this point in time a sufficient amount of energy is supplied to the mechanical oscillation system in order that the swinging movement of the latter although damped itself, is maintained like an undamped oscillation.

The signal pattern D1 in FIG. 3 characterizes the function of the rectangular synchronizing pulses which drive the field effect transistor 14 of FIG. 1 into its conducting state so that during the respective pulse length, the switching transistor 17 can be effectively switched on. When the whole system is in the synchronous state, there arise in the drive circuit the current pulses shown in pattern D1 which have different amplitudes corresponding to the voltage pulses of the pattern C1. The synchronization pulses are likewise depicted in the signal pattern D1; however, their current value is very small in the blocked state of the switching transistor 17 and has the order of magnitude of leakage current values. Therefore, FIG. 3 does not give a picture of the time and amplitude values according to their exact dimensions, but is to be regarded as merely a scheme for illustrating the inter-relations of the invention. Energy has to be supplied to the system each time the state of largest kinetic energy has been attained; and hence, the moment the large primary pulse P in D1 advantageously coincides with the moment, the mechanical oscillator 20 passes through its central position. Subsequently, the single pulses depicted in the D-patterns will be designated as primary pulses P and the smaller double pulses as secondary pulses S1 and S2. It is further evident that the secondary pulses S1 and S2 occur symmetrically to a state of greatest kinetic energy, i.e., with respect to time, they occur symmetrically to each second passage of the mechanical swinger 20 through its central position, i.e., whenever the movement of the swinger changes direction. Therefore, the first secondary pulse S1 supports the acceleration of the swinger 20 whereas the second secondary pulse S2 supports the retardation of the mechanical swinger 20 which occurs after its passage through the central position. Thus, in the synchronous state, a compensating effect between the two secondary pulses S1 and S2 is obtained, provided that both pulses S1 and S2 have the same energy values.

Considering now a situation wherein ambient influences cause the mechanical swinging system to tend to a positive error, i.e., the clock driven by the system tends to run too fast. Then, with respect to time, all electrical effects occur earlier than the synchronizing pulses so as to result in the state of the signal patterns C2 and D2 shown in FIG. 3. The collector voltage of the switching transistor 17 now becomes distorted since the synchronizing pulses as shown by the pattern D2 can switch only part of the respective drive pulse. Thereby, the leading edge of the pulse P of D1 is delayed so that the energy required for the maintenance of the movement is supplied to the swinging system at a later point of time and the swinging period is lengthened in the direction of a decrease in the frequency of oscillations; on the other hand, the secondary pulse S1 is suppressed by the delay of synchronizing pulses so that only the secondary pulse S2 is effective. This secondary pulse S2 is no longer compensated by a secondary pulse S1 so that energy is supplied to the swinging system at a point in time which comes after a state of maximum kinetic energy of the mechanical swinger 20 and leads to a lengthening of the swinging period thereby decreasing the frequency of the movement.

The opposite effects to the foregoing result in the case of a drive running too slow. In that case, only the respective secondary pulse S1 becomes effective while the secondary pulse S2 is suppressed. The primary pulse P is prematurely cut off because the mechanical processes occur too late with respect to the synchronizing pulses. The corresponding patterns are depicted as C3 and D3 in FIG. 3. The primary pulses P are prematurely ended by the trailing edges of the synchronizing pulse thereby adjusting the point of time earlier at which the energy required for the maintenance of the movement is supplied. This shortens the oscillator period and increases the frequency. In addition, the synchronizing pulses, as shown by the pattern D3, are premature with respect to the voltage pulses of the pattern C3 so that the secondary pulse S2 is eliminated and the secondary pulse S1 supplies additional energy each time before the mechanical swinger passes through the central position. This results in a shortening of the oscillatory period or in an increase of frequency, respectively.

By the above-described principle it is possible to attain an automatic synchronization of positive and negative errors since at each tendency for acceleration or retardation, causes automatic switching to one of the two secondary pulses S1 and S2 to occur and switching to such a pulse compensates each tendency or frequency variation of the mechanical swinger 20 from the synchronization frequency.

FIG. 4 serves to depict schematically the principle underlying the results of the processes described above in connection with FIG. 3. For the cases described, FIG. 4 shows three different velocity curves, $v1$, $v2$, and $v3$, in relation to an amplitude curve $a$ which is valid for the synchronous state. The velocity $v1$ corresponds to the synchronous state and is out of phase by 90° in relation to the amplitude curve $a$. The velocity $v2$ corresponds to the rate which is too fast and is depicted by the dash-dotted curve. The velocity $v3$ corresponds to the rate which is too slow and is depicted by the dashed curve. The moments at which the secondary pulses S1 and S2 occur (FIG. 3) shows the effect which the supply of additional energy exerts in each case. Thereby, velocity changes which lie symmetrically to the respective velocity maximum occur only in case of the synchronous curve V1. For the velocity $v2$ which is too high an abrupt velocity change can be seen each time the velocity decreases after having reached a maximum value whereby a dynamic equilibrium is aimed at for this state and thus, the period is prolonged and the frequency of oscillation is decreased. The opposite case applies for the velocity $v3$ which is too low and comprises an additional velocity change before the maximum value is reached. Thereby, the system tends to a dynamic equilibrium for this state so that the period is shortened and the frequency is increased.

FIG. 4 is only a schematic representation of the velocity curves and is not intended to depict the actually existing relations. The plotted amplitude curve $a$ does not show the changes which the two secondary pulses S1 and S2 cause in the synchronous state. Furthermore, FIG. 4 shows why during a synchronization process the respective secondary pulse which only is effective has a greater amplitude than both secondary pulses S1 and S2 in the synchronous state (FIG. 3). The greater secondary pulse S2 in the pattern D2 (FIG. 3) is obtained because at the respective instant at which the oscillation velocity $v2$, although showing a higher peak value on account of its higher frequency, nevertheless has a value which lies below the corresponding value of the normal velocity $v1$; therefore, as a consequence of the now lesser velocity, the counter E.M.F. present in the inductive system is smaller than normal so that a higher current pulse can be generated for the only available secondary pulse S2 (compare also pattern C2 in FIG. 3). This additionally supplied energy when compared with the synchronous state, has the further effect of prolonging the swinging period and thereby the frequency of oscillations is diminished. In this manner the tendency of the system to run faster is likewise compensated.

In case of a negative error, the remaining secondary pulse S1 is for similar reasons stronger than in the synchronous state since the velocity $v3$ of the movement at the instant of the secondary pulse is smaller than in the normal case because the drive moves too slow. Associated therewith is a smaller counter e.m.f. which provides a respectively stronger current flow in the drive circuit. Thus, the greater energy of the remaining secondary pulse S1 shortens the swinging period of the system and increases its frequency.

The above explanation, especially that of the signal patterns depicted in FIG. 3 shows importance of the pulse length which at least equals the total width of the current pulses which are induced in one inductor when the inductors move pass the permanent magnet assemblies 21 or 22. These current pulses result in the voltage which in FIG. 3 are depicted under B and C, respectively. These pulses which are generated each time a coil 18 or 19 is moved through two adjacnet magnet fields consist, as described, of two short pulses S1 and S2 having a relatively small amplitude and a central pulse P having a relatively large amplitude. The processes associated with these pulses which have been depicted in FIG. 3 by D1, D2, and D3 must function both for the synchronous state as well as for each type of error. Hence, the width of the synchronizing pulses should at least be equal to the total width of the pulses induced in each case. Further, the length of the intervals between the synchronizing pulses is important. Preferably, the interval length should at least equal half the pulse length. It follows that when the intervals between the impulses are too small, the very effect of suppressing one of the secondary pulses S1 and S2 is prevented because the relative displacement of the synchronizing pulses with respect to the mechanical effects as has been described for the positive and negative errors, is compensated for by a synchronizing pulse which follows or precedes too closely. Thus, it becomes also evident that there is a limit to the use of higher frequencies of the synchronizing pulses since the described adverse effects occur when the intervals between the pulses are too small. The described correlations between the pulse length and the length of the interval of the synchronizing pulses signify in connection with the total width of the induced inpulses that these values are adjusted according to the mechanical dimensions of the swinging system.

An alternative embodiment for accomplishing synchronization provides the field effect transistor 14 in the collector circuit or the base circuit of the switching transistor 17. However, it has been found that the best results are achieved when the field effect transistor 14 is connected to the emitter of the switching transistor 17 because in an interrupted emitter circuit, the base of the switching transistor 17 is charged to a higher static rest potential during the pulse intervals, which results in higher current values and steeper current increases when the collector current flow is commenced. The better efficiency thus achieved results in a very large range of control for the synchronization process.

Rectangular synchronizing pulses could also be replaced with pulses which have an increasing or decreasing slope or have an amplitude which is not constant during the pulse duration. As to the circuit which is each time switched by the field effect transistor 14 of the circuit arrangement shown in FIG. 1, care is to be taken that the current flow in this circuit is not in any case so affected that the secondary pulses S1 and S2 are distorted with respect to time and amplitude.

What is claimed is:

1. A circuit for synchronizing electrodynamic clockwork drives having a first and second inductor and two permanent magnet assemblies wherein said magnet assemblies are moved relative to said inductors by a mechanical oscillation system having the inherent frequency $f$, comprising:

a switching transistor having a conducting circuit coupled to a power supply and a control circuit;

said first inductor being disposed in series in the conducting circuit of said switching transistor;

said second inductor being disposed in the control circuit of said switching transistor whereby current pulses induced in said second inductor by said magnet assemblies switch said switching transistor to its conducting state;

a source of synchronizing pulses including a series connection of a quartz controlled oscillator, a frequency divider and a one-shot multivibrator producing synchronizing pulses having a frequency of $2^a \cdot f$ where $a = 1,2,3 \ldots$ and a duration at least equal to the duration of the current pulses induced in said inductors by said magnet assemblies; and a field-effect transistor connected in series in one of said transistor circuits and to the output of said multivibrator for triggering said field-effect transistor by said synchronizing pulses whereby the circuit automatically synchronizes an electrodynamic clockwork drive connected to said mechanical oscillation system.

2. A circuit for synchronizing an electrodynamic clockwork drive system wherein a first and second inductor and two permanent magnet assemblies are moved in an oscillatory manner passed each other by a mechanical oscillation system having the inherent frequency $f$, to induce in said inductors a primary current pulse of one polarity and a pair of secondary current pulses of opposite polarity symmetrically disposed about the primary current pulse for each passage of inductors and magnet assemblies passed each other in a first direction and like shaped pulses of opposite polarity for each passage in the return direction comprising:

a switching transistor having a conducting circuit including an emitter and a control circuit including a base;

a power supply connected in series in said conducting circuit;

said first inductor being connected in series in the conducting circuit of said switching transistor;

said second inductor being disposed in said control circuit of said switching transistor whereby current pulses of a first polarity induced in said second inductor by said magnet assembly switch said switching transistor to its conducting state;

a switching element having switching terminals connected in series in one of said transistor circuits and control means whereby power supply current can only pass through said transistor and first inductor during a conducting state of said switching element between the switching terminals thereof; and a source of synchronizing pulses connected to the control means of said switching element to switch the element into a conducting state between the switching terminals thereof and producing synchronizing control pulses having a frequency of $2^a \cdot f$ where $a = 1,2,3 \ldots$ and including means establishing said synchronizing pulses having lengths substantially twice the lengths of intervals betweens pulses and duration at least equal to the durations of the current pulses induced in said inductors for each passage of said inductors and magnet assemblies whereby the circuit automatically synchronizes an electrodynamic clockwork drive connected to said mechanical oscillation system.

3. The circuit defined in claim 1 wherein the switching terminals of said switching element are connected in series with the emitter of said switching transistor.

4. The circuit defined in claim 1 wherein the switching terminals of said switching element are connected in series with the base of said switching transistor.

5. The circuit defined in claim 1 wherein said synchronizing pulses are substantially rectangular in shape.

6. A method of synchronizing an electrodynamic clockwork drive having first and second inductors magnetically coupled to a pair of permanent magnets of the drive that are moved relative to the inductors in an oscillatory movement of an inherent frequency $f$ to induce in said second inductor current pulses that consist of a pair of low amplitude secondary pulses of a first polarity symmetrically disposed on opposite sides of a higher amplitude primary pulse of a second polarity for one direction of relative motion of inductors and magnets and like pulses of opposite polarities for the opposite direction of relative motion of inductors and magnets comprising the steps of generating synchronizing pulses having a frequency of $2^a \cdot f$ where $a$ is an integer and said synchronizing pulses having a duration at least equal to each induced primary pulse and associated secondary pulses the intervals between said synchronizing pulses being substantially one-half the length of said synchronizing pulses, energizing said first inductor in accordance with induced pulses of a first polarity in said second inductor to thus primarily drive said magnets relative to said inductors once per oscillation thereof, and modifying the energization of said first inductor by said synchronizing pulses as the oscillation frequency departs from synchronization with the synchronizing pulses by reducing the magnitude of energization of said first inductor with selected secondary pulses to automatically compensate said drive for any variations in predetermined frequency thereof.

7. The method of claim 6 further defined by said synchronizing pulses having a substantially rectangular shape.

* * * * *